US005191986A

United States Patent [19]

Huizenga

[11] Patent Number: 5,191,986

[45] Date of Patent: Mar. 9, 1993

[54] STORAGE ORGANIZER SYSTEM AND METHOD FOR INSTALLING THE SAME

[76] Inventor: Lee M. Huizenga, 1298 Waukazoo Dr., Holland, Mich. 49424

[21] Appl. No.: 896,147

[22] Filed: Jun. 9, 1992

[51] Int. Cl.[5] ..... A47F 5/00

[52] U.S. Cl. ..... 211/189; 211/87; 211/90

[58] Field of Search ..... 211/87, 90, 187, 189; 312/245

[56] References Cited

U.S. PATENT DOCUMENTS 3,478,891 11/1969 Kaeslin ..... 211/90 X
3,634,983 1/1972 Welch ..... 211/90 X
3,899,228 8/1975 Schreiber .
4,160,570 7/1979 Bridges .
4,324,076 4/1982 Honickman .
4,403,700 9/1983 Manlove .
4,634,010 1/1987 Otema .
4,697,713 10/1987 Pryor ..... 211/189
4,928,833 5/1990 Huizenga .
5,044,285 9/1991 Wolfe ..... 211/90 X
5,097,771 3/1992 James ..... 211/90

*Primary Examiner*—Robert W. Gibson, Jr.
*Attorney, Agent, or Firm*—Price, Heneveld, Cooper, DeWitt & Litton

[57] ABSTRACT

A storage organizer system and method of installation in which the system is formed of panels that are secured together to provide a center section assembly including two vertical panels spaced parallel to each other with shelves extending therebetween. This center section assembly is mounted on a cleat on which the center section assembly is hung and secured. Rods are mounted between the side walls of the space in which the organizer system is mounted to provide hanger rods at different levels.

12 Claims, 2 Drawing Sheets

STORAGE ORGANIZER SYSTEM AND METHOD FOR INSTALLING THE SAME

This invention relates to a simplified, inexpensive storage organizer system and a method for installing such a system. The primary use for the system is as a closet organizer although there are other possible uses.

BACKGROUND OF THE INVENTION

Presently, there are many systems for use as storage organizers in closets and the like. For example, reference is made to my U.S. Pat. No. 4,928,833 which discloses a low cost storage organizer system. However, there has been a need for an organizing system which is even less expensive and requires less operations on the components before they are packaged as a knock-down kit.

SUMMARY OF THE INVENTION

In accordance with this invention, I provide a storage organizer system and a process for installing the same which serves essentially the same purpose as present-day organizers that are adapted to be installed in a space which comprises a back wall and two end walls extending forwardly therefrom. My system preferably includes seven wood parts, five rods, a number of screws, and ten rod end supports all of which can be easily packaged in a 4'×2' package.

The storage organizer system includes a center section assembly including two vertical panels spaced parallel to each other with vertically spaced shelves mounted between the two vertical panels. A cleat which is of the same length as the shelves is secured horizontally to the back wall. The center section assembly is hung and mounted on this cleat by screws extending through the vertical panels into the ends of the cleat. The kit also includes wooden rod support members mounted on the end walls at the same height as the panels A rod end support is mounted on each of the wooden rod supports and the panels. Support rods for supporting the hanging of clothing or the like are mounted on the rod end supports Preferably, another set of rods are mounted below the aforementioned rods between the end wall and the vertical panels.

In accordance with the method of this invention, the center section assembly is first assembled, the cleat is mounted on the back wall in a horizontal position and the center section assembly is then hung and secured to the cleat with one of the shelves resting on the cleat. Then the screws are screwed through each vertical panel into the ends of the cleat. Next, the two wooden rod support members are mounted on the side wall at the same height as the panels of the center section assembly and the rod end supports are mounted on the wooden rod supports after which the rods are snapped into place onto the rod end supports. The entire assembly is then completed by attaching lower rod end supports on the side walls and on the panels after which another pair of rods are snapped into place.

BRIEF DESCRIPTION OF THE PREFERRED EMBODIMENT

Figure 1:
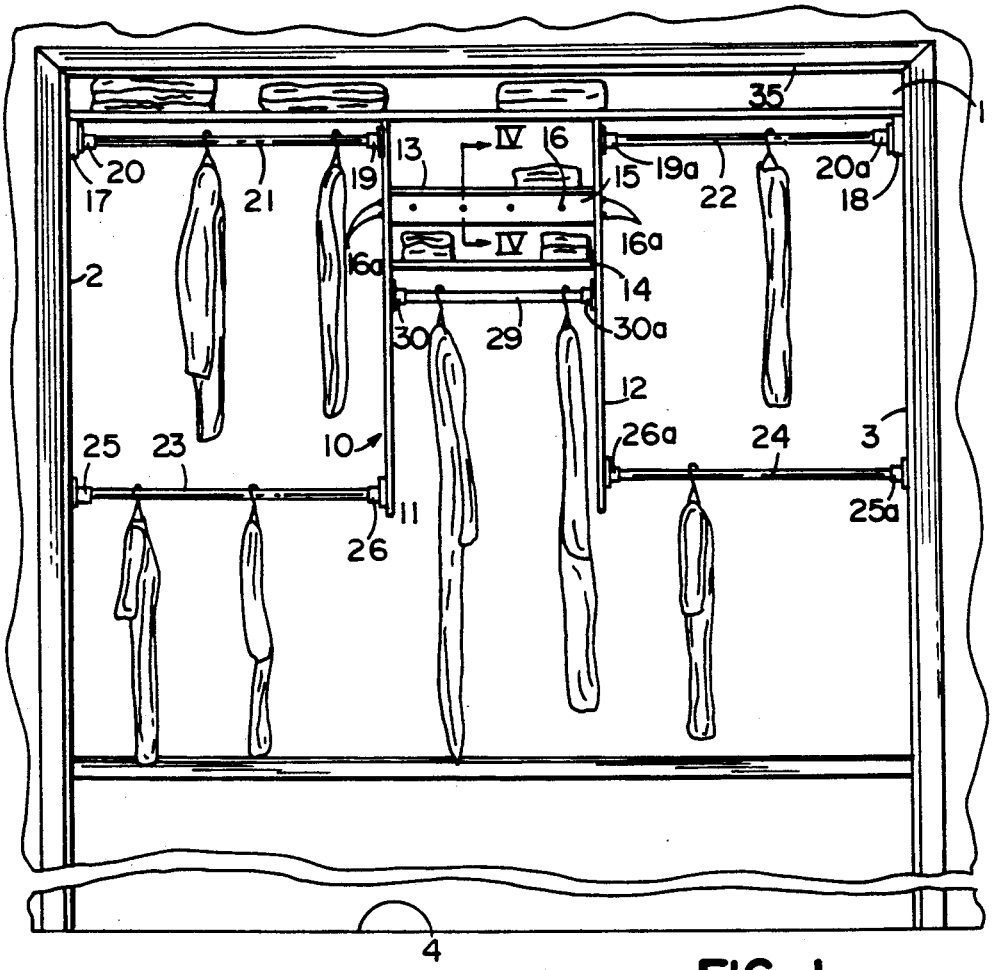
FIG. 1 is an elevational, front view of a storage organizer system of this invention.
Figure 2:
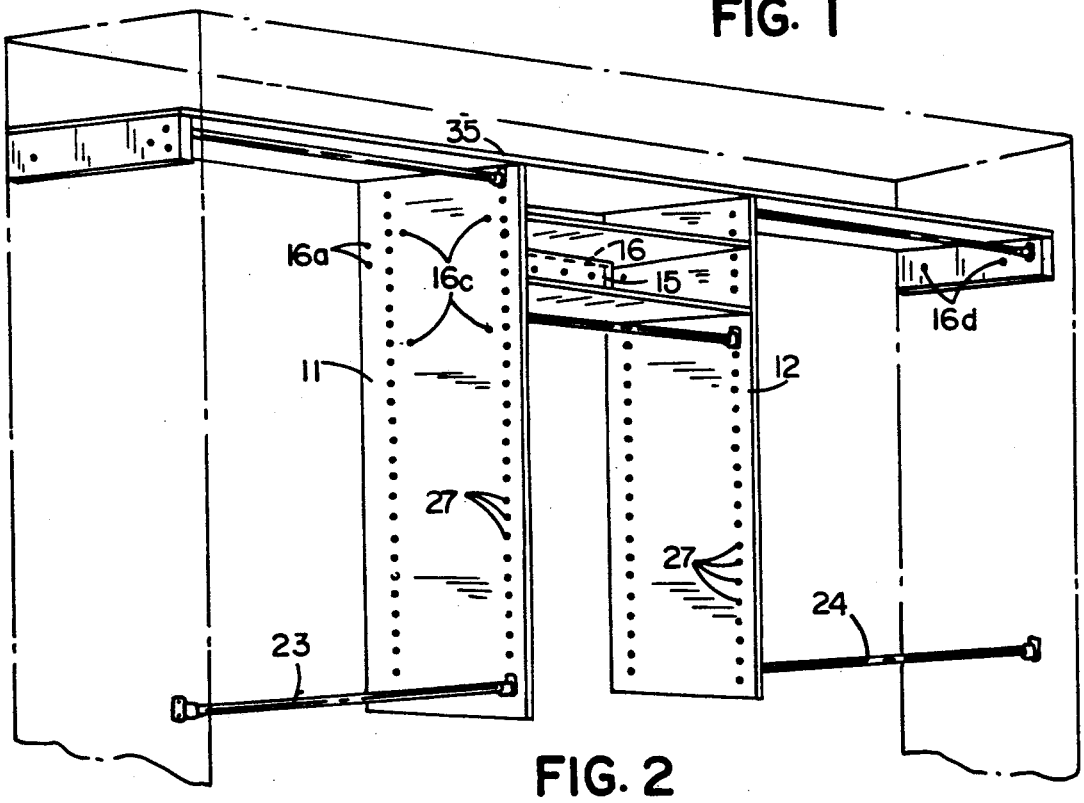
FIG. 2 is an elevational, front, perspective view of the storage organizer system of FIG. 1.

Referring to the drawings, FIGS. 1 and 2 disclose a recessed storage space or compartment such as a closet which includes the back wall 1, the side walls 2 and 3, and the floor 4. Mounted on the back wall is a center section assembly 10 which includes the two panels 11 and 12 between which is secured the shelves 13 and 14.

The center section assembly 10 is mounted on a cleat 15 by resting one of the shelves, such as the upper shelf 13, on the cleat 15. Cleat 15 is secured to the back wall 1 by screws 16. The center section assembly is secured to the cleat 15 by the screws 16*a* (FIG. 2) extending through the panels 11 and 12 and into the ends of the cleat, such ends being sufficiently thick to accommodate and securely receive the screws 16.

Wooden rod supports 17 and 18 are securely mounted on the end walls 2 and 3, respectively, by screws 16*d* extending through the wooden rod supports and into studs or anchors embedded in the side walls. The end panel 11 and wooden rod support 17 supports rod 21 for hanging clothing and the like by means of the rod end supports 19 and 20. The panel 12 and wooden rod support 18 support the rod 22 by the rod end supports 19*a* and 20*a*. At the lower end of the panels 11 and 12 are provided another pair of rods 23 and 24. Rod 23 is supported by the rod end supports 25 and 26. Rod 24 is supported by rod end supports 25*a* and 26*a*. Rod 29 is mounted between panels 11 and 12 by rod end supports 30 and 30*a*. The rod end supports 19, 19*a*, 26, 26*a*, 30, and 30*a* are supported in pairs of the pre-drilled openings 27 as will be explained hereinafter. Similarly, rod end supports 20 and 20*a* are mounted in pre-drilled openings in wooden rod supports 17 and 18, respectively. Rod end support 25*a* is mounted on the end wall 2 by screws screwed into a stud or into an anchor embedded into the end wall. Similarly, rod end support 25*a* is secured to the side wall 3 so as to support the rod 24.

As will be noted, the system provides storage in the center section assembly for clothing on the shelving 13 and 14 and hang-up clothes on the rods 21, 22, 23, 24, and 29.

Referring to each of the components forming the system, the vertical panels 11 and 12 are identical. They are preferably 48 inches long, 14 inches wide, and $\frac{3}{4}$ inches thick laminated panels, although the panels could be made of solid wood or other material and be of different lengths and widths. Two vertical rows of 32 mm holes 27 are provided on each side of the panels as disclosed in FIG. 2. As previously stated, these holes are provided to receive rod end supports 19, 19*a*, 25, 25*a*, 26, 26*a*, 30, and 30*a* which will be described in greater detail hereinafter. Similar openings (not shown) are provided in the wooden rod supports 17 and 18 to receive the rod end supports 20 and 28, respectively.

Cleat 15 is a $\frac{3}{4}\times4\times23\frac{7}{8}$ board. The two shelves 14 and 15 are each constructed of a $14''\times23\frac{7}{8}$ laminated panel, although the panels could be made of solid wood. The two wooden rod supports 17 and 18 are solid or laminated panels 20 inches wide, 6 inches high and ⅝ inch thick each of which, as disclosed above, have openings for mounting the rod end supports 20 and 20a. Rods 21, 22, 23, 24, and 29 are preferably one-inch metal rods coated with a plastic material.

Figure 5:
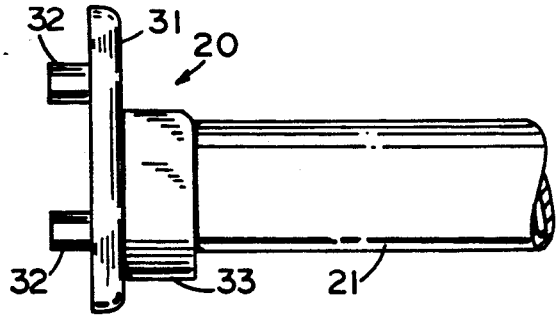
FIG. 5 is a side elevational view of one of the rod end supports and a portion of a rod snapped into place therein.
Figure 6:
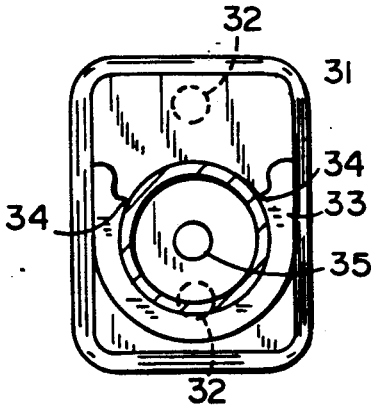
FIG. 6 is front elevational view of rod end support and rod of FIG. 5.

FIGS. 5 and 6 disclosed one of the rod end supports 20 as an example of the other rod end supports 19, 19a, 20a, 25, 25a, 26, 26a, 30, and 30a. Rod end support 19a includes the base 31 having the pins 32 extending from one side thereof and a rod support flange 33 extending from the opposite side thereof. The flange 33 is U-shaped to receive the end of the rod 21. Dimples 34 are formed in the saddle portion of flange 33. Rod end support 19a is mounted on panel 11 by the two pins 32 extending into pre-drilled spaced openings 27. The rod 21 is supported in the saddled portion of the U-shaped flange 33 which includes a ridge or dimples 34 over which the rod 21 is forced to snap into place and be held therein. It should be understood that the above description of the rod end support 19 also applies to the other rod end supports except that two rod end supports 25 and 25a are slightly different. In lieu of pins 32, rod end supports 25 and 25a are mounted on side walls 2 and 3 by screws extending through the opening 35 and into anchors or studs located in the side walls 2 and 3.

Having described all the components of my invention, the method of installation will now be described.

METHOD OF INSTALLATION

Installation of my organizer system is extremely simple. It starts by assembling the two vertical side panels 11 and 12 and the shelves 13 and 14 into a center section assembly. This is accomplished by arranging the shelves typically 8½ inches and 17 inches down from the top of the two vertical panels and using 1¼ inch screws 16c for screwing the two shelves 13, 14 to the vertical panels 11, 12. Rod 29 is then mounted between panels 11 and 12 by the rod end supports 30 and 30a which are mounted to the panels by the pins 32 being inserted in pre-drilled openings 27. This completes the assembly of the center section assembly ready to be installed on the back wall 1.

Using a level, a level line is then drawn approximately two feet long and 74 inches above the floor 4. This line is positioned to be near the center of the wall 1 where the center section assembly is to be hung. The exact position to hang the center section assembly is then determined and the location of the left and right sides of the assembly is marked on the level line. Preferably, the marks on one side are placed 34⅜ inches from the outside wall of the closet so that the rods provided in the kit do not have to be cut on that side of the vertical panel.

The cleat 15 is then placed on the back wall below the level line and between the location of the side panels. The wall cleat is then drilled and screwed to the wall preferably using two-inch screws 16 located at a stud or studs and/or anchors in the wall.

After the cleat 15 has been securely mounted on the back wall, the center section 10 is set over the cleat with the upper shelf placed on top of the cleat 15 and two screws 16a, preferably at least 1¼ inches long, are driven through the side panels 11 and 12 into each end of the cleat 15.

Having mounted the center section assembly 10 on the back wall 1, the left and right wooden rod supports 17 and 18 are mounted on the side walls 2 and 3, respectively. This is accomplished by using a level to locate the position of the wooden rod supports with the top edge of each support 17 and 18 being parallel to and at the same height above the floor as the top edges of the panels 11 and 12. The wooden rod supports 17 and 18 are secured to the side wall using screws 16d screwed into studs or anchors mounted in the wall board of the side walls.

The rod end supports 20 and 20a are then placed in the pre-drilled holes in the wooden rod supports 17 and 18. The rod end supports 19 and 19a are also inserted in the pre-drilled holes 27 of the panels 11 and 12. The placement of the rod end supports 19, 19a and 20, 20a are as disclosed in FIGS. 1 and 2 so as to receive the rods 21 and 22 in a horizontal position. The two rods 21 and 22 are then cut to length, if necessary, for a tight fit and are snapped into place on the rod end supports 20, 19 and 20a, 19a.

The lower rods 23 and 24 are then installed by inserting the pins 32 of the rod end supports 26 and 26a into the pre-drilled holes 27. The rod end supports 25 and 25a, which as previously pointed out are different from rod end supports 26 and 26a, are mounted on the side walls 2 and 3, respectively, by screws extending through opening 35 and screwed directly into the end walls using anchors. The position of the rod end supports 25, 26 and 25a, 26a obviously are at a location where the lower rods are straight and level. The rods 23 and 24 are then snapped into the rod end supports.

Figure 3:
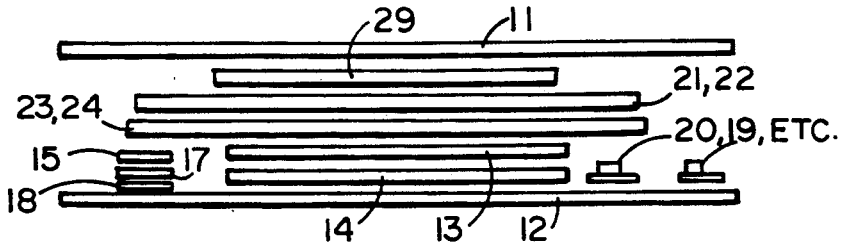
FIG. 3 is an illustrative view of the parts forming the kit for constructing the storage organizer system of this invention.
Figure 4:
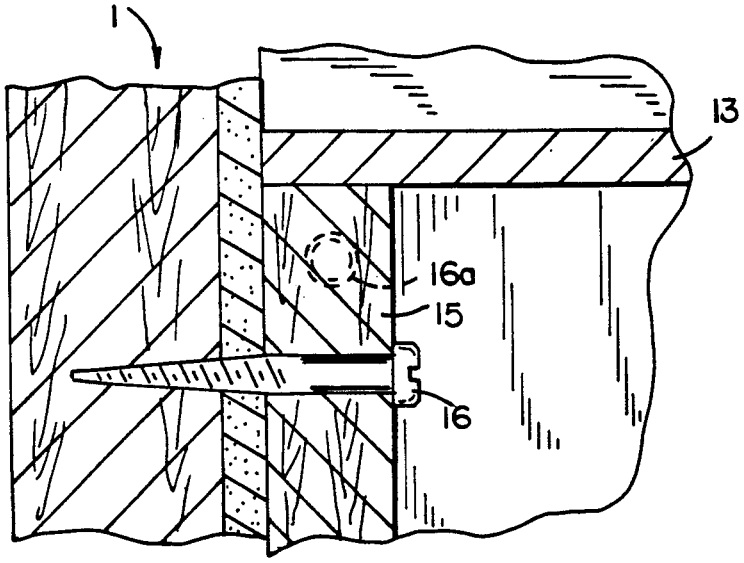
FIG. 4 is a cross-sectional view taken along the plane IV—IV of FIG. 1.

Shelf storage space can be increased by adding a top shelf such as the shelf 35. Because of the length of the shelf, it preferably does not constitute a part of the kit as disclosed in FIG. 3. It is a piece which the installer would purchase separately from the kit or a remodeler would use their existing top shelf.

For a longer closet than 96 inches, two or more closet organizers can be combined to provide full utilization of the storage space.

From the above description, it should be clear that the kit of the above-described storage organizer system has an extremely low initial cost because of the lack of any special operations to be performed on the components thereof. Further, it utilizes conventional wood products which only require cutting such products into specified lengths and widths. There is no special hardware required to assemble and install the wooden parts. It is relatively simple to install and can be done by do-it-yourselfers as well as contractors. In addition, the parts can be packaged very easily into a relatively small package.

Although I have described a preferred embodiment of my invention, it should be understood that several different embodiments and modifications can be made without parting from the real spirit of this invention. Therefore, this invention should be limited only as set forth in the following appended claims.

I claim:

1. A storage organizer system for a storage space having a back wall extending vertically upwardly, two spaced parallel side walls extending vertically upwardly and perpendicularly forward of said back wall and a floor comprising:

a center section assembly including two vertical panels spaced parallel to each other and having a vertical edge with at least one shelf extending therebetween and rigidly secured thereto;

a wooden cleat having a length equal to the distance between said vertical panel/, said cleat being secured horizontally to said back wall a distance above the floor greater than the vertical length of said vertical panels, said cleat having sufficient thickness extending from said back wall to receive a fastener extending into the ends thereof;

said center section assembly mounted on said cleat with the vertical edges of said vertical panels abutting the back wall and said shelf resting on the top edge of said cleat with fasteners extending through said vertical panels and into the ends of said cleat; and support rods extending between and secured to said vertical panels and said side walls.

2. The storage organizer system of claim 1 in which rectilinear wooden rod support members are mounted on said side walls, said support members having a top edge parallel to and at the same height above the floor as the top edge of said vertical panels;

rod end supports mounted on each of said vertical panels and said wooden rod supports; and said support rods having ends mounted on said rod end supports

3. The storage organizer system of claim 2 in which a support rod is mounted on and between said vertical panels and below said shelf.

4. The storage organizer system of claim 1 in which vertically spaced shelves extend between and are rigidly secured to said vertical panels.

5. The storage organizer system of claim 1 in which the support rods extending between and secured to said vertical panels includes two vertically spaced rods on each side of said center section assembly for providing additional support for said center section assembly and for providing additional hanging support.

6. The storage organizer system of claim 2 in which a shelf extending from one side wall to the other is mounted on the top edges of said rod supports and vertical panels.

7. In a method of constructing a storage organizer in a storage space having a back wall extending vertically upwardly, two spaced parallel side walls extending vertically upwardly and perpendicularly forward of said back wall and a floor comprising the steps of:

providing two rectangular panels of identical size and said panels each having a vertical edge along its length shape;

providing at least one rectangular shelf;

rigidly securing said shelf between said panels with said panels being in parallel relationship and said shelf extending perpendicular to said panels thereby providing a center section assembly;

providing a cleat having a length equal to the distance between said parallel panels;

securing said cleat to said back wall in a horizontal position on said back wall and located a distance above the floor greater than the vertical length of said panels, said cleat having sufficiently thick ends to receive a fastener extending into the ends thereof;

mounting said center section assembly on said cleat with the vertical edges of said panels abutting the back wall and said shelf resting on the top edge of said cleat;

fastening said panels to the ends of said cleat; and securing support rods to and between the vertical panels and side walls.

8. The method of claim 7 in which a rectilinear wooden rod support member having a linear top edge is provided for each of said side walls and mounting said support members on said side walls with said top edge parallel to and at the same height as the top edge of said panels;

providing a plurality of rod end supports and mounting the same on each of said vertical panels and wooden rod supports; and mounting said support rods on said rod end supports.

9. The method of claim 8 in which another rod support is provided and mounted on and between said vertical panels and below said shelf.

10. The method of claim 7 in which another rectangular shelf is provided and mounted parallel to said one rectangular shelf and on and between said panels.

11. The method of claim 7 in which two additional support rods are provided and one of said additional support rods is mounted on and between one of said panels and one of said side walls and the other of said support rods is mounted on and between the other of said panels and the other of said side walls.

12. The method of constructing a storage organizer in accordance with claim 8 in which after the steps of claim 8 have been completed, a rectangular shelf having a length equal to the spacing between said side walls is provided and mounted over the top edges of said rod supports and panels.

* * * * *